US005307050A

United States Patent [19]

Patton et al.

[11] Patent Number: 5,307,050

[45] Date of Patent: Apr. 26, 1994

[54] DISPLAY APPARATUS FOR A FIRST OUT TYPE OF FAULT STATUS ANNUNCIATOR HAVING A SERIES OF INTERLOCK SWITCHES

[75] Inventors: Paul B. Patton, Rockford; Gregory J. Merten, Eagan, both of Minn.

[73] Assignee: Honeywell Inc., Minneapolis, Minn.

[21] Appl. No.: 893,166

[22] Filed: Jun. 3, 1992

[51] Int. Cl.[5] ..... G08B 23/00

[52] U.S. Cl. ..... 340/517; 340/500; 340/525; 340/461

[58] Field of Search ..... 340/517, 518, 519, 520, 340/521, 525, 500, 509, 510, 439, 459, 461

[56] References Cited

U.S. PATENT DOCUMENTS

| | | | |
|---|---|---|---|
| 3,665,399 | 5/1972 | Zehr et al. | 340/525 |
| 3,967,281 | 6/1976 | Dageford | 340/415 |
| 4,271,402 | 6/1981 | Kastura et al. | 340/518 |
| 4,295,129 | 10/1981 | Cade | 340/520 |
| 4,451,225 | 6/1984 | Landis | 431/14 |
| 4,471,348 | 9/1984 | London et al. | 340/521 |
| 4,943,919 | 7/1990 | Aslin et al. | 340/525 |

OTHER PUBLICATIONS

Fireye Bulletin E1001 (Nov. 1988).
Fireye Bulletin E3001 (Sep. 1988).
Fireye Bulletin C610 (Feb. 1980).

*Primary Examiner*—Donnie L. Crosland
*Attorney, Agent, or Firm*—Edward L. Schwarz

[57] ABSTRACT

An annunciator for the status of interlock switches connected into a series circuit for supplying power from a power source to a load, includes a memory recording the status of each switch at a selectable instant. A plurality of display elements are arranged in a pattern corresponding to the pattern of the interlock switch circuit. A manually operable switch allows a user to select for graphically showing with the display either the switch status recorded by the memory or the current status of the switches. The signals controlling the display are conditioned so that the particular display element assigned to the first out switch as recorded in the memory flashes to indicate the switch closest to the power source which was not conducting at the selectable instant.

7 Claims, 2 Drawing Sheets

DISPLAY APPARATUS FOR A FIRST OUT TYPE OF FAULT STATUS ANNUNCIATOR HAVING A SERIES OF INTERLOCK SWITCHES

BACKGROUND OF THE INVENTION

Many types of control systems are used to operate apparatus which has the potential for causing harm or injury if various parameter levels are outside of predetermined ranges. A simple example is the automobile whose engine will be severely damaged if the oil pressure is too low or the coolant temperature is too high. In this situation the system relies on the good judgment of the driver to stop the auto as soon as the warning light or gauge indicates the problem.

In many of these systems however, human monitoring of the apparatus parameters may be unacceptable because the apparatus is intended to operate automatically, or because the result of improper, that is to say human, monitoring may result in serious damage of injury. Neither is it desirable to rely on the control system to monitor every one of these parameter levels and shut down of the system when needed because this adds substantial complexity to the controller. Also, the control system can on occasion fail, for example because of power outages. Instead, in most systems these parameters are used to directly control interlock switches which open if the parameter level is outside of the predetermined range. In these systems, the interlock switches are typically arranged in a series circuit which passes the current for operating the apparatus (and parts of the control system as well in many cases) so that if any of the parameter levels are outside the range specified for it, the apparatus will not receive power and cannot operate. Examples of these series circuits of interlock switches are found in a number of different types of apparatus and their controls, including as one example burner systems and controls. In burner controls, the interlock switch series circuit is used to control power which operates the fuel valves. If any of the burner system parameters are outside the specified ranges, power is not available to the fuel valves, with the result that the burner cannot operate.

A problem which arises in these systems is determining the cause of a malfunction. If an interlock switch opens, power to the system is interrupted of course, but the problem can be in any of the parameters controlling the interlock switches or in other aspects of the system. For example, in burner systems flame failure does not control an interlock switch. In this particular situation, the control system itself interprets the flame sensor signal and shuts down the fuel valves when flame is detected as absent. When the shutdown is caused by open interlock switch, by the time a repairer arrives to correct the problem, the original cause of the shutdown may no longer exist. As one example of this situation, a low fuel pressure parameter which opens an interlock switch may have been restored within a few seconds and thus will not be apparent to the repairer. Even when latching interlock switches are used, on occasion a second fault may occur after the first fault and before the diagnostic procedures can be started. It is then difficult to determine the cause of the original shutdown. Early annunciators for use with these switch strings simply showed current status of the switches, which was not always adequate for easy troubleshooting.

In order to simplify and improve troubleshooting of malfunctions in these systems, improved annunciators have been designed which record the status of each of the interlock switches in the interlock switch string at the time a fault is detected. Thus for example, U.S. Pat. No. 4,295,129 (Cade) describes a circuit connected to individual interlock switches and the main and pilot valve actuators, to detect abnormal conditions by sensing the status of the fuel valves and to record the identity of the first interlock switch or fuel valve to open at the time the abnormal condition was detected. U.S. Pat. No. 3,967,281 (Dageford) attempts to determine the earlier of two detected failures and record the identity of the switch which first opened. These will typically be related, but may happen in either order, and an indication of the earlier allows easier detection of the underlying problem.

Frequently, knowledge of the current status is helpful during troubleshooting. A problem with the present systems is that it is not possible during troubleshooting, without losing the first out status, to determine the current status of the switches without individually testing or inspecting them. While such individual testing or inspecting is possible, it is laborious when a large number of switches are involved. Furthermore, the current states of these switches may change during the troubleshooting, resulting in further troubleshooting problems.

CROSS REFERENCE TO RELATED APPLICATION

A co-pending application entitled "Data Acquisition Apparatus with Time Correlation to an External Event" a common filing date and common inventorship and ownership with this application.

BRIEF DESCRIPTION OF THE INVENTION

The improved annunciator provides both current and first out status of a plurality of interlock switches each having first and second contacts and connected by a plurality of conductors to form therefrom a series circuit of interlock switches in a preselected sequence for connection by an end interlock switch thereof to a power source to pass current through the series circuit to a load. (By "status" with respect to interlock switches is meant its conductive status, i.e., whether it is open or closed.) When voltage is detected on a conductor, this implies that every interlock switch between it and the power source is closed.

The annunciator includes a plurality of voltage sensors each associated with an interlock switch and connected to a conductor connected to the interlock switch with which the voltage sensor is associated and each voltage sensor providing a status signal having a first state responsive to presence of power voltage on the conductor to which it is connected and a second state otherwise. A display unit has a display panel with a plurality of display elements mounted thereon with each display element associated with one of the voltage sensors. Each of the display elements receives a display signal and enters a first display state responsive to a first state of the display signal and a second display state responsive to a second state of the display signal.

A memory receives the status signals from the voltage sensors, records the state of at least one and typically all of the status signals at a selectable instant, and provides memory signals encoding the state of the status signals at the selectable instant. Each one of the display drivers is associated with a single display element, that display element's corresponding interlock switch, and that interlock switch's associated voltage sensor. Each display driver provides to its associated display element a display signal having its first and second states responsive respectively to the first and second states of a control signal.

The improvement arises in multiplexer means receiving the status signals from the voltage sensors, the memory signal from the memory, and a selection signal having first and second states, for providing control signals to the display drivers encoding the states of the status signals responsive to the first state of the selection signal and encoding the states of the memory signals responsive to the second state of the selection signal. Mode selecting means provide to the multiplexer means the selection signal with its first state responsive to a first state of the mode selecting means, and for providing the selection signal with its second state responsive to a second state of the mode selecting means.

In a preferred embodiment, this annunciator is used with a controller monitoring operation of the load and issuing a fault signal which enters a second level responsive to a preselected status of the load and a first level otherwise. In this application the mode selecting means further comprises toggle means receiving the fault signal and a switch signal. The toggle means provides a toggle signal having first and second levels, with the toggle signal having its second level responsive to the fault signal entering its second level, and changing its level responsive to a level change in a switch signal. The switch means includes a manually operable element, for providing the switch signal with a level change therein to the toggle means responsive to operation of the manually operable element. Gate means receives the fault signal and the toggle signal, for providing the selection signal with the second level responsive to the second levels of both the fault signal and the toggle signal.

There is also a provision for causing the first out display element to alternate between its two display states, i.e. to flash in order to draw the user's attention more clearly to the interlock switch which had first open status when the fault was detected.

DESCRIPTION OF THE PREFERRED EMBODIMENTS

Figure 1:
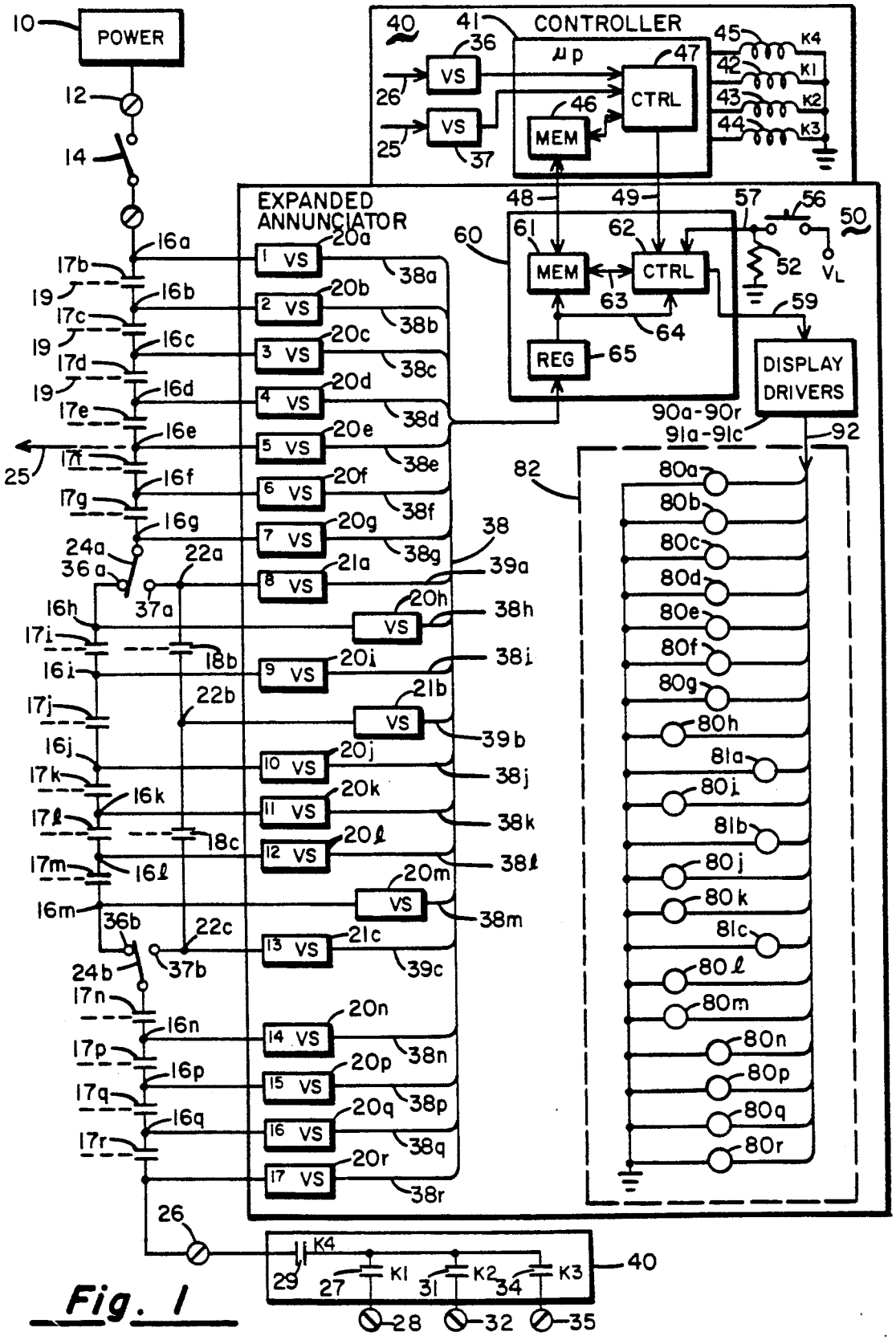
FIG. 1 shows a series circuit of interlock switches and the circuitry which senses and displays their conduction status.

In FIG. 1, an expanded annunciator 50 is shown connected to a typical arrangement of series circuits of interlock switches intended for control of a burner installation. Power, usually at line voltage, for operating the burner installation is provided by a source 10 to a power terminal 12. (The symbol at 12 represents a screw terminal and implies that the connection is at a terminal block on the unit, rather than internal to the unit.) Switch 14 represents a manually controlled burner switch which when opened, disables operation of the entire burner system. Switch 17*b* is typically a thermostat or other demand driven sensor which closes when the burner is to operate. There is a series circuit of various limit, control, or interlock switches 17*b*–17*r*, 18*b*, and 18*c* which will be referred to hereafter as simply interlock switches, although some of them, for example the thermostat switch 17*b*, may not have a strictly safety purpose. Each interlock switch has first and second contacts which are opened and closed by the parameter which it is intended to monitor. Power to operate the burner system must pass through all of the interlock switches 17*b*–17*r* or through the alternate path of interlock switches 18*b* and 18*c* selected by SPDT switches 24*a* and 24*b*. When all of these switches are closed, then power will be present on the interlock terminal 26.

The entire burner installation is controlled by a controller 40 shown in two different parts at the top and bottom of FIG. 1. Controller 40 sequences the operation of the various component elements of the installation and provides power switching for the critical components. Modern burner controllers rely on a microprocessor 41 to provide this sequencing as well as safety functions, a level of fault annunciation, and in many cases, control of levels of fuel and air to maximize efficiency. Microprocessor 41 is shown as including the standard internal features of a memory 46 and a control unit 47. As used herein, the term microprocessor refers to any processing element in association with a memory.

It is useful to discuss briefly the close correspondence between a microprocessor implementation of a particular logic or data manipulation function and hardware which performs the implementation. By properly programming a suitable microprocessor, it can replicate or emulate the operation of a logic or data processing circuit. Since there are any number of approaches to a software implementation of an application it is most appropriate to disclose the invention in terms of the microprocessor elements which comprise its hardware best mode, and this will be done. Those skilled in the art know well how to implement in software the logic gates, oscillator, multiplexer, memory, etc. by which the best mode and explanation of the invention is presented below.

Standard component elements of controller 40 other than microprocessor 41 as shown in FIG. 1 include a K4 safety relay having a winding 45 and contacts 29, a K1 relay for ignition having a winding 42 and contacts 27, a K2 relay for controlling the pilot valve actuator and having a winding 43 and contacts 31, and a K3 relay for controlling the main valve and having a winding 44 and contacts 34. Power is supplied to the K1–K3 operating relay contacts 27, 31, and 34 through the K4 safety relay contacts 29. As microprocessor 41 energizes the individual relay windings, the associated contacts close and power is applied to the individual burner components in the proper order and at the proper time through the screw terminals 28, 32, and 35 shown connected to them. A flame sensor is also required, and its output must indicate flame to allow the K3 relay contacts 34 to remain closed during operation. There is usually a blower for furnishing combustion air to the burner, and the air flow sensor will be one of the interlock switches, typically switch 17*n*. Often there will be a modulation control for the main valve as well. All of these functions operate under control of the controller 40.

Microprocessor 41 is shown as providing actuating signals to the windings 42–45 of the K1–K4 relays. The K4 relay contacts 29 are normally open and are held closed by periodic execution of a watchdog routine by the microprocessor. A microprocessor 41 malfunction will usually prevent the periodic execution of the watchdog routine by the microprocessor which results in opening contacts 29 and closing of the main fuel valve. Microprocessor 41 also provides the control signals for a number of the other parameters involved with burner operation. Typically, these parameters include the combustion air and main fuel flow rates, which are not shown in this representation.

For safe and efficient operation of a burner installation, the values of the previously mentioned operating parameters must fall within preselected ranges. Each interlock switch 17*b*–17*r*, 18*b*, and 18*c* is operatively connected, usually mechanically, to a sensing element which causes its associated switch to open when the associated parameter value falls outside of the preselected range. Dotted lines 19 symbolize the connections between each interlock switch 17*b*–17*r*, 18*b*, and 18*c* and its associated sensing element which controls the conductive status of the interlock switch. The interlock switches 17*b*–17*r*, 18*b*, and 18*c* are connected into four separate series circuits of switches by individual conductors 16*b*–16*q* and 22*b*. These conductors 16*b*–16*q* and 22*b* comprise a normal part of a burner installation and are standard line voltage wiring.

In the burner control system for which this invention is tailored, the following table sets out the various interlock switches and the parameters controlling their conductive status.

| Interlock Switch | Control Parameter |
|---|---|
| 17b | Thermostat |
| 17c | Auxiliary switch No. 1 |
| 17d | Auxiliary switch No. 2 |
| 17e | Low water cutoff |
| 17f | High temperature limit |
| 17g | Auxiliary switch No. 3 |
| 17i | High oil pressure |
| 17j | Low oil pressure |
| 17k | High oil temperature |
| 17l | Low oil temperature |
| 17m | Atomizing switch |
| 17n | Air flow |
| 17p | Auxiliary switch No. 4 |
| 17q | Auxiliary switch No. 5 |
| 17r | Other interlocks |
| 18b | High gas pressure |
| 18c | Low gas pressure |

One can see from this table that the parameters which control the interlock switches include temperature, pressure, air flow rate, and water level. The series circuit comprising interlock switches 17*i*–17*m* are used only when oil is the fuel. The series circuit of interlock switches 18*b* and 18*c* is used only when gas is the fuel. The user selects between the two fuels with a double pole double throw oil/gas select switch comprising a ganged pair of single pole double throw (SPDT) switches 24*a* and 24*b*. When the switches 24*a* and 24*b* are connected to the oil contacts 36*a* and 36*b*, the position shown in FIG. 1, the series circuit for oil parameters comprising interlock switches 17*i*–17*m* is placed in series with both the series circuits comprising switches 17*b*–17*g* and 17*n*–17*r* to make a single series circuit of interlock switches for use with fuel oil. When the oil contacts 36*a* and 36*b* are selected by SPDT switches 24*a* and 24*b*, then when any of the switches in the active series circuits are open, power is not available at terminal 26 to the relay contacts 27, 31, and 34, and therefore regardless of the relay contacts' conductive status, power cannot be supplied to the igniter through terminal 28 or to the pilot and main valves through terminals 32 and 35 respectively. When the switches 24*a* and 24*b* are thrown to connect to the gas contacts 37*a* and 37*b*, then a single series circuit of interlock switches for use with natural gas is formed. If any of these interlock switches are open at any time, power is not provided to the ignition, pilot valve, and main valve terminals 29, 32, and 35, and operation of the burner installation cannot occur. One can realize that with such a complex series circuit of interlock switches, any malfunction, particularly a transient one, can become a real challenge to diagnose.

Figure 2:
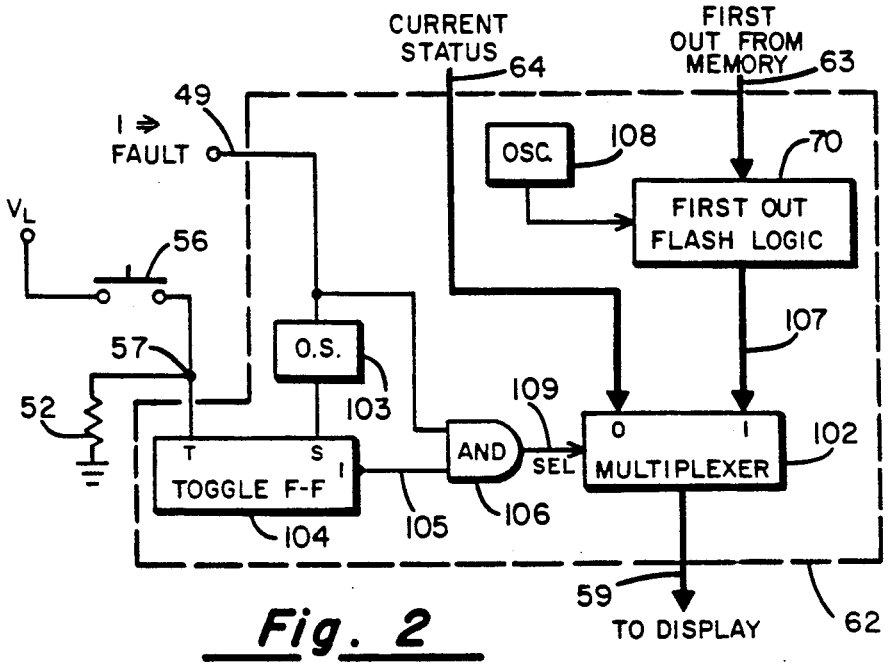
FIG. 2 shows a logic block diagram which represents the apparatus which selects the status signal data for display.
Figure 3:
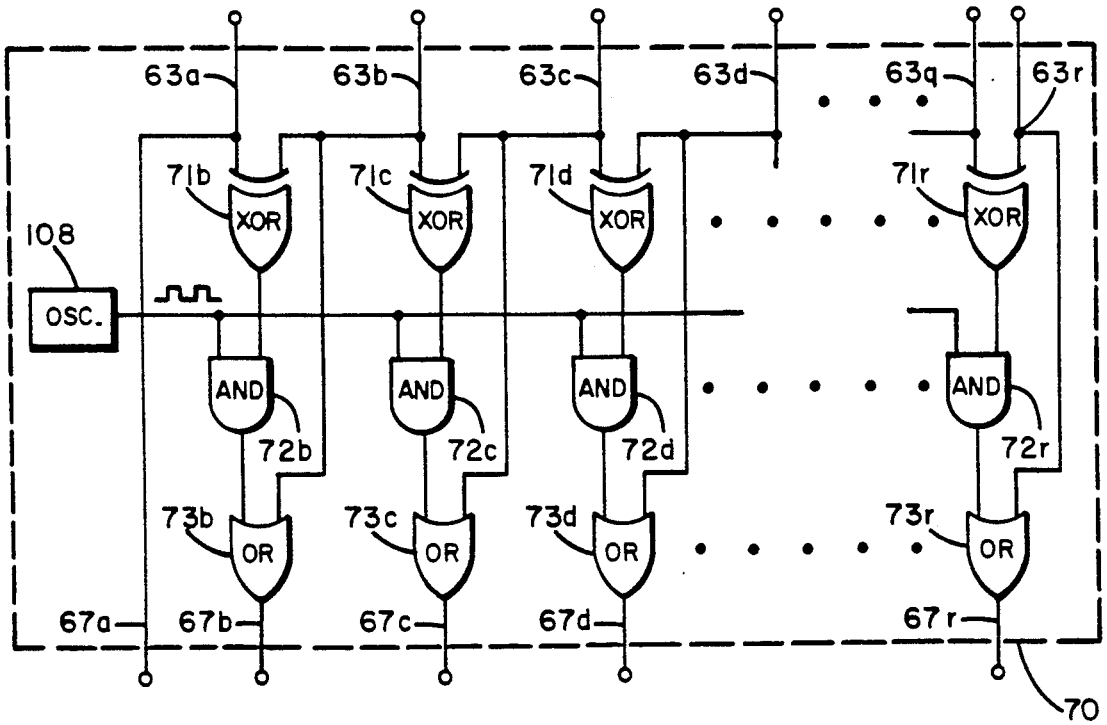
FIG. 3 is a hardware-based circuit which will cause the display element assigned to the interlock switch with first out status to flash when displaying first out information.

Annunciator 50 provides for improved fault diagnosis. Annunciator 50 includes a microprocessor 60 which provides a number of the important annunciator functions. One important feature in annunciator 50 is the ability to select the source of switch data displayed by the annunciator. Either the status of the switches at the time a fault was sensed, or the current status of the switches can be shown. The reader is reminded that in FIG. 1 these functions are shown at a system level and that the description is intended to allow one with skill in the art to generate the software for microprocessor 60 which will allow him or her to adapt the invention to the particular situation FIGS. 2 and 3 show the invention on a detailed block diagram/logic element level for replication either in hardware or by software within a microprocessor.

Annunciator 50 includes voltage sensors 20*a*–20*r* and 21*a*–21*c* each having an input terminal connected to one of the conductors 16*a*–16*q* and 22*a*–22*c*, and by which conductor the input terminal is connected to at least one interlock switch contact. The alphabetic component of each voltage sensor's reference number is in general the same as one of the interlock switches to which it is connected and the one with which it is associated. For example, voltage sensor 20*b* is connected to switches 17*b* and 17*c* and associated with interlock switch 17*b*. Voltage sensor 22*c* is associated with interlock switch 18*c* and connected to switches 17*c* and 17*d*. One can see that if the interlock switch with which a particular voltage sensor is associated, as well as all of the interlock switches between that interlock switch and power terminal 12 are all closed, then voltage will be present on the conductor to which the voltage sensor is connected. (The reader will note that there are a number of additional voltage sensors, such as voltage sensors 20*h* and 21*a*, which are not associated in the way described with an interlock switch in this preferred embodiment. The information provided by these voltage sensors is nonetheless often useful in determining the cause of a detected fault.) Each voltage sensor 20*a*–20*r* and 21*a*–21*c* provides a logic level status signal on its output path 38*a*–38*r* or 39*a*–39*c* attached as shown and which will be collectively referred to hereafter as paths 38. Each status signal has a first logic level state when power voltage is not present on the connector to which the input terminal of the voltage sensor is connected, and a second logic level state when power voltage is present on the associated input terminal.

Status signals carried on paths 38 are received and recorded in condensed form by the annunciator 50 which identifies only the first out switch. We prefer to use the internal or on board memory 61 of microprocessor 60 for recording these status signals. A register 65 is provided to continually record the current states of the status signals. While the precise format used by memory 61 and register 65 in recording the status signals does not form a part of this invention, it will nevertheless be briefly discussed. Power applied to interlock switches 17b–17r, 18b, and 18c will appear on a particular conductor 16a–16q and 22a–22c only if each switch between it and terminal 12 is closed. Therefore, a first state of the status signal provided by a voltage sensor implies that the interlock switch with which that voltage sensor is associated as well as every switch between that interlock switch and the power terminal 12, is closed. If the status signals provided by the voltage sensors connected to the two contacts of a particular interlock switch are different from each other, then the interlock switch between them must be open This switch will be referred to hereafter as the "first open" or "first out" switch. Thus, by definition all of the interlock switches between the first open switch and power terminal 12 must be closed.

Because of the way in which switch status is determined, only the first open interlock switch can be sensed as such. Therefore, all of the information about switch status available at a given instant can be specified by identifying the first open switch. Accordingly, an identity code is assigned to each voltage sensor. For illustrative purposes, a numeric identity code for each voltage sensor of FIG. 1 is shown within each block symbolizing a voltage sensor. It is preferred that memory 61 and register 65 simply record the identity code of the first open voltage sensor. Experience shows that information identifying the first open switch is sufficient to allow one to determine the vast majority of faults arising during operation of such a burner installation. In our embodiment of an annunciator 50, there is no error detecting function. In our preferred embodiment of annunciator 50, memory 61 simply maintains a history extending over several seconds of the status of voltage sensor output. This history function allows one to take into account delays between detection of a fault and actual recording and annunciation of the switch status at the instant of fault detection. Control element 62 of microprocessor 60 mediates this storage function as well as controls all of the operations within annunciator 50.

Data transfers within, to, and from annunciator 50 may be either on a parallel path, or serially. Choice of the type of transfer is a matter of convenience. The heavy lines for paths 38, 59, 63, and 64 symbolize parallel transfer of data. The narrow line for paths 48 and 49 indicates serial data transfer between microprocessors 41 and 60. No notice of the type of transfer involved need be taken however, since the two types of transfer are completely equivalent. Path 48 has two way transmission capability.

An important input to control element 62 is the toggle signal on path 57 which specifies that the source for the display information should be changed. A switch 56 when closed by pushing applies logic voltage $V_L$ to path 57 which is sensed by control element 62. When switch 56 is not pushed, pull-down resistor 52 holds a 0 volt logic level on path 57. On the basis of the mode selected by either pushing switch 56 or initially by the occurrence of a fault (signalled on path 49), control element 62 selects either the current status signals carried on paths 38 or the status signals recorded earlier in memory 61 and then selected by control element 62 according to criteria described in our co-pending application referenced above. Until the fault is cleared, control element 62 then places on path 59 control signals encoding the states of the selected status signals.

Controller 40 includes a voltage sensor 36 receiving at its input terminal the voltage at terminal 26 and providing to microprocessor 41 a logic level status signal whose level indicates the voltage on terminal 26. When power is available on terminal 26, then power for operating the ignition and fuel valves is available. By monitoring terminal 26 voltage, it is possible for microprocessor 41 to determine presence of a large number of different types of faulty operation. It is also possible at the discretion of the operator or installer to place a separate connection 25 between a selected one of the conductors 16a–16q or 22a–22c, and voltage sensor 37 within controller 40. The status signal provided to controller 40 by voltage sensor 37 can form a further basis for sensing faulty operation of the burner system. Should the signal levels provided by voltage sensors 36 (and 37 if present) not be compatible with the current operating phase of the burner installation, then the control element 47 in microprocessor 41 provides on path 49 a fault signal which includes a time delay value indicating to control element 62 of microprocessor 60, the time elapsed since the fault was detected and the final receipt of the fault signal by microprocessor 60. In the data transmission scheme used here between microprocessors 41 and 60, there are significant random delays, on the order of several hundred milliseconds, which may arise between the actual occurrence of the event which prompts a request for data transmission and completion of the data transmission. By using the time delay value in the fault signal from microprocessor 41, and by measuring other delays within itself, microprocessor 60 can then inspect the switch status history table within its memory 61 and determine the status of the switches at the time the fault was detected, i.e., the first out switch status. For reasons not important to this invention, the first out switch status information is sent to microprocessor 41 on path 48 and then returned to memory 61 for display by annunciator 50.

Annunciator 50 further includes display drivers 90a–90r and 91a–91c, a display panel 82 shown in dotted outline, and display elements 80a–80r and 81a–81c, as well as data paths 92 connecting the display drivers to the display elements. The display elements are mounted on panel 82 in an arrangement analogous to the relative positions of the conductors 16a–16r and 22a–22c and the interlock switches which they connect, so as to represent their order or sequence in a conventional schematic of such a series circuit of switches as shown in FIG. 1. Each of the display elements 80a–80r and 81a–81c has a first distinct display state when receiving operating power from its associated display driver and a second display state when not receiving power from a display driver. We prefer to use standard light emitting diodes (LEDs) as the display elements 80a–80r and 81a–81c, and the first display state occurs when the LED is receiving power from its driver. The second display state corresponds to absence of light from the LED when no power is applied to it by its display driver.

The individual display elements are arranged so that the relative location of each in panel 82 corresponds to the location in the schematic of the series circuit of interlock switches, of the interlock switch associated with that display element. We prefer to print on the surface of panel 82, an actual sketch of the series circuit, with individual interlock switches placed adjacent to their associated display elements. This provides a very understandable demonstration of the location of a detected fault.

The control signals on paths 59 cause the display drivers to provide display signals on paths 92 to the display drivers. These are arranged so that the control signal on paths 59 for a particular driver was derived from a status signal originating from the conductor whose position in the series circuit corresponds to the position of the display element which receives its display signal from that driver. Thus, the display signal for display element 80*a* encodes a value which originated from the status signal supplied by voltage sensor 20*a*. The display signal supplied to element 81*a* contains information originating with voltage sensor 21*a*.

As an example of the operation of annunciator 50, consider the situation where switch 14 is closed and switches 24*a* and 24*b* are positioned as shown in FIG. 1. Assume that microprocessor 41 senses a fault when all switches are closed except switches 17*k* and 17*p*. Switch 17*k* is therefore the first open or first out switch. Voltage sensors 20*a*–20*j* provide first states for their status signals carried on paths 38. All other voltage sensors provide status signals having their second states. At some point after the fault is sensed, the fault signal is placed on path 49 in response to which microprocessor 60 determines the switch status at the time of the fault from the switch history table in memory 61. In our preferred design, the first out switch identifier is sent on path 48 to microprocessor 41 and then back to memory 61 in microprocessor 60. This first out status information specifies that display elements 80*a*–80*j* receive power from their display drivers, and light. Control element 62 provides signals on path 59 to display drivers 90*a*–90*r* and 91*a*–91*c* that display elements 80*a*–80*j* receive power with the remaining display elements unpowered. This is true irrespective of the number of switches among the group of 17*l*–17*r* which are closed.

Suppose that at some later time after this first fault has occurred, the condition causing switch 17*k* to be open no longer exists and switch 17*k* closes, switch 17*p* still remaining open and becoming the first open switch. If no other changes to the system occurs, then the lighting of the display elements will not change, because the first out switch status information within memories 46 and 61 does not change. If, however, switch 56 is operated, then control element 62 selects path 38 for its switch status information, and display elements 70*a*–70*n* light. It is possible to toggle between these two sources for switch status data by successively pressing switch 56.

One useful feature of this invention not shown in the FIG. 1 apparatus and which forms a part of microprocessor 60, senses the identity of the first open voltage sensor and causes the display driver associated with it to repetitively start and stop power to its associated display element. This causes the associated display element to flash on and off, and call the attention of the operator to the location of the problem. This feature will b disclosed in connection with FIG. 3.

FIG. 2 shows a hardware implementation of the apparatus for selecting the source for switch status information, which the software of a microprocessor embodiment must emulate in order to perform the functions of this invention. The fault signal on path 49 is assumed to have a second state (logical 1) once a fault is sensed until the fault is cleared manually at which point it returns to its first state (logical 0) and remains thus until another fault is detected. This fault signal may be provided by a flip-flop or memory bit within microprocessor 41 and which is not shown, which sets in response to detection of a fault and must be manually cleared.

The necessary elements of control element 62 for selecting the switch status data source are shown in FIG. 2 as including a toggle flip-flop 104 having T and S input terminals. The mode select switch signal on path 57 forms the input to the T terminal of toggle flip-flop 104. For a such a toggle flip-flop, each low to high transition on the T terminal causes the output terminal signal on path 105 to change from a first (logical 0) state to a second (logical 1) state or, if in the second state, to the first state. A low to high transition applied to the S terminal by one-shot 103 causes the output signal to set to its second (logical 1) state. There is a further consideration of bounce by switch 56, where pressing it a single time may generate two closely spaced low to high transitions interpreted by the circuitry as more than one actuation. A simple way to handle this problem is to assume a one-shot receives the signal on path 57 and provides the input signal to the T terminal.

AND gate 106 receives the fault signal on path 49 and the toggle flip-flop 104 output on path 105. If AND gate 106 receives logical 1 signals on both input terminals, then line 109 carries a logical 1 from AND gate 106 and a logical 0 otherwise. AND gate 106 provides the select (SEL) signal to a multiplexer 102 which actually specifies the input source for the multiplexer. A logical 0 SEL signal specifies the "0" input port to which the current status signal paths 64 are connected. A logical 1 SEL signal specifies the "1" input port to which the memory data paths 63 are connected through the flash logic 70. The data from the selected input source is provided by multiplexer 102 to the display drivers 90*a*–90*r* and 91*a*–91*c* on path 59. In this way the first out information is displayed immediately after a fault occurs, and if there is no fault then only current status information can be displayed.

We prefer to alternate the output of the display element which receives the first out signal from memory 61 between its first and second states to more strongly draw the technician's attention to the interlock switch at which the problem probably arose. The flash logic element 70 performs this function. The rate of alternating this display element output is determined by an oscillator 108 which provides an oscillator signal to flash logic element 70. Preferably, the oscillator signal from oscillator 108 changes state from two to 20 times per second, i.e., has a cycle rate of from one to ten hertz.

While the data manipulation operations of microprocessor 60 in annunciator 50 are controlled by software which is resident in the instruction memory of control element 62, it is helpful to understand the structure and operation of flash logic element 70 from a standpoint of the hardware which control element 62 emulates. This hardware is shown in FIG. 3 and should serve as a substitute for a suitable flow chart when this feature of the invention is implemented in software. In FIG. 3, the signals provided on paths 63 are shown as if provided in a parallel arrangement on paths 63*a*–63*r* and corresponding to the original signals provided by voltage sensors 20*a*–20*r* and then recorded in memory 61. Flash logic element 70 is shown as comprising a plurality of exclusive OR (XOR) elements 71*b*–71*r* each of which receive on their input terminals the memory signals provided by the two voltage sensors connected to the contacts of a particular interlock switch. The alphabetic part of each XOR element's reference number designates the reference number of the interlock switch to whose contacts these voltage sensors are connected. Thus, XOR element 71*b* receives the recorded status signals provided by voltage sensor 20*a* and 20*b*, which receive their inputs from connectors 16*a* and 16*b* which are connected to the two contacts of switch 17*b*. The output of an XOR element is of course a logical 1 if the two inputs have different values, and a logical 0 otherwise.

Flash logic element 70 further comprises AND gates 72*b*–72*r* which receive at one input, the output of the XOR element sharing its reference number's alphabetic component. The second input of each AND gate 72*b*–72*r* is supplied by oscillator 108. Each of the OR gates 73*b*–73*r* receive as its inputs, the output of the one AND gate 72*b*–72*r* and the memory signal on the one of the paths 63*b*–63*r* sharing the same alphabetic character as the OR gate itself. The outputs of the OR gates 73*b*–73*r* comprise the first out signals provided to port 1 of the multiplexer 62.

When two memory signals having sequential alphabetic components in their reference numbers are of different logic values, the output of the related XOR element is a logical 1. As the oscillator 108 provides portions of its output signal which has a logical 1, the inputs of the AND gate involved are satisfied and its output oscillates at the rate of the oscillator 10 signal. The OR gate receiving this AND gate output as one input then provides an output oscillating at the rate of the oscillator signal provided that the other OR gate input is a logical 0. The other OR gate input is a logical 0 when the interlock switch is open with its contact closer to the power terminal 12 having power voltage on it and the other contact at 0 volts.

As an example, assume that the recorded status signals on paths 63*a* and 63*b* have the second (logical 1) state, and the status signals on paths 63*c*–63*r* have the first, logical 0, state. XOR element 71*c* provides a logical 1 output and all of the other XOR elements provide a logical 0 output. AND gate 72*c* provides an output to one input of OR gate 73*c* which oscillates in phase with the output of oscillator 108. Since there is a logical 0 on path 63*c* provided to the other input of OR gate 73*c*, its output on path 67*c* oscillates in phase with the oscillator signal. OR gate 73*b* receives a continuous logical 1 signal input on path 63*b* and therefore provides a continuous logical 1 output on path 67*b*. OR gates 73*d*–73*r* receive a continuous logical 0 signal input from paths 63*d*–73*r* as well as a logical 0 input from their associated AND gate 72*d*–72*r* and therefore provide a continuous logical 0 output on path 67*b*. AND gates 72*d*–72*r* each provide a logical 0 output because the XOR gate associated with each receives identical logical 0 inputs and therefore provides a logical 0 as an input to the AND gate.

The preceding has described our invention. What we wish to claim by letters patent as our invention is:

1. In an annunciator of the status of a plurality of interlock switches each having first and second contacts and connected by a plurality of conductors to form therefrom a series circuit of interlock switches in a preselected sequence for connection by an end interlock switch thereof to a power source to pass current through the series circuit to a load, and including:

a) a plurality of voltage sensors each associated with an interlock switch and connected to a conductor connected to the interlock switch with which the voltage sensor is associated and each voltage sensor providing a status signal having a first state responsive to presence of power voltage on the conductor to which it is connected and a second state otherwise;

b) a display unit having a display panel with a plurality of display elements mounted thereon with each display element associated with one of the voltage sensors, each of said display elements receiving a display signal and entering a first display state responsive to a first state of the display signal and a second display state responsive to a second state of the display signal;

c) a memory receiving the status signals from the voltage sensors, recording the state of at least one of the status signals at a selectable instant, and providing at least one memory signal encoding the state of a single status signal at the selectable instant; and d) a plurality of display drivers, each display driver associated with a single display element, that display element's corresponding interlock switch, and that interlock switch's associated voltage sensor, each display driver providing to its associated display element a display signal having its first and second states responsive respectively to the first and second states of a control signal, wherein the improvement comprises:

multiplexer means receiving the status signals from the voltage sensors, the memory signal from the memory, and a selection signal having first and second states, for providing control signals to the display drivers encoding the states of the status signals responsive to the first state of the selection signal and encoding the states of the memory signals responsive to the second state of the selection signal; and mode selecting means for providing the selection signal with its first state responsive to a first state of the mode selecting means, and for providing the selection signal with its second state responsive to a second state of the mode selecting means.

2. The annunciator of claim 1, for use with a controller monitoring operation of the load and issuing a fault signal entering a second level responsive to a preselected status of the load and having a first level otherwise, wherein the mode selecting means further comprises:

a) toggle means receiving the fault signal and a switch signal, for providing a toggle signal having first and second levels, said toggle signal having its second level responsive to the fault signal entering its second level, and changing its level responsive to a level change in a switch signal;

b) switch means including an alterable element, for providing the switch signal with a level change therein to the toggle means responsive to operation of the alterable element; and c) gate means receiving the fault signal and the toggle signal, for providing the selection signal with the second level responsive to the second levels of both the fault signal and the toggle signal.

3. The annunciator of claim 2, wherein the toggle means comprises a toggle flip-flop having a toggle terminal receiving the switch signal, a set terminal receiving the fault signal, and a data terminal providing the toggle signal to the gate means, said toggle flip-flop changing the level of the toggle signal responsive to a predetermined change in the level of the switch signal, and setting the toggle signal to its second level responsive to the fault signal changing from its first state to its second state.

4. The annunciator of claim 3 wherein the gate means comprises an AND gate.

5. The apparatus of claim 1, and wherein the memory records a plurality of status signals provided by voltage sensors associated with a plurality of sequential interlock switches and provides for each recorded status signal, an associated memory signal encoding the value of the recorded status signal, said multiplexer further comprising:

a) an oscillator providing an oscillator signal having first and second states each of preselected duration;

b) a flash logic means receiving a pair of memory signals associated with a pair of status signals provided by the voltage sensors connected to the contacts of a single interlock switch and the oscillator signal, for providing a control signal encoding the state of a preselected one of the status signals encode in the pair of memory signals when at least one of the conditions exist of i) the states of the status signals encoded in the pair of memory signals are the same, and ii) the oscillator signal has its first state, and a second state otherwise.

6. The annunciator of claim 5, wherein the flash logic means comprises an exclusive OR gate receiving the pair of memory signals as inputs, and providing a logic signal having a first state when the pair of memory signals have opposite states, an AND gate receiving the exclusive OR gate output signal and the oscillator signal as input signals and providing an output signal having the second state when both input signals have the second state, and an OR gate receiving one memory signal and the AND gate output as input signals and providing an output signal having the second state when at least one of the input signals have the second state, and having the first state otherwise.

7. The annunciator of claim 5, wherein the oscillator provides an oscillator signal changing state from two to 20 times per second.

* * * * *

UNITED STATES PATENT AND TRADEMARK OFFICE

CERTIFICATE OF CORRECTION

PATENT NO. : 5,307,050

DATED : Apr. 26, 1994

INVENTOR(S) : Paul B. Patton, Rockford; Gregory J. Merten, Eagan, Both of Minn

It is certified that error appears in the above-identified patent and that said Letters Patent is hereby corrected as shown below:

Column 14, line 1, delete "encode", insert --encoded--.

Signed and Sealed this

Eleventh Day of October, 1994

*Attest:*

*Attesting Officer*

Bruce Lehman

BRUCE LEHMAN

*Commissioner of Patents and Trademarks*